United States Patent [19]

Heldman et al.

[11] Patent Number: 5,022,308

[45] Date of Patent: Jun. 11, 1991

[54] AMMUNITION MAGAZINE FOR A COMBAT VEHICLE

[75] Inventors: Henrich Heldman, Kassel; Erich Wallwey, Vellmar, both of Fed. Rep. of Germany

[73] Assignee: Wegmann & Co. GmbH, Kassel, Fed. Rep. of Germany

[21] Appl. No.: 548,037

[22] Filed: Jul. 5, 1990

[30] Foreign Application Priority Data

Jul. 7, 1989 [DE] Fed. Rep. of Germany ..... 3922318

[51] Int. Cl.[5] ..... F41A 9/13

[52] U.S. Cl. ..... 89/45; 89/34

[58] Field of Search ..... 89/45, 46, 34, 33.02, 89/33.1

[56] References Cited

U.S. PATENT DOCUMENTS

| | | | |
|---|---|---|---|
| 2,474,975 | 7/1949 | Goodhue | 89/34 |
| 2,988,962 | 6/1961 | Finn | 89/34 |
| 4,535,677 | 8/1985 | Panhke et al. | 89/34 |
| 4,947,728 | 8/1990 | Muhlhausen et al. | 89/46 |

FOREIGN PATENT DOCUMENTS

| | | | |
|---|---|---|---|
| 2818279 | 11/1979 | Fed. Rep. of Germany | 89/45 |
| 2200731 | 8/1988 | United Kingdom | 89/45 |

*Primary Examiner*—Deborah L. Kyle
*Assistant Examiner*—Stephen Johnson
*Attorney, Agent, or Firm*—Sprung Horn Kramer & Woods

[57] ABSTRACT

An ammunition magazine for a combat vehicle, wherein the shells are stowed upright and perpendicular to the floor and when they are removed automatically by an ammunition positioner that has an arm with a pivoting pickup at its end, with several magazine shafts, wherein the shells are stowed with their base against a base plate and secured by a shell holder. The shell holder has at least two pairs of tongs-like shell-securing arms that at least partly surround the jacket of the shell, one side of which rests against a stationary guide, on the opposite side, that pivot one above another toward the longitudinal axis of the magazine shaft and, closing subject to a resilient force, around another axis that parallels the first outside the magazine shaft, and that, when closed, can be locked closed by a mechanism that can be unlocked by a component on the positioning arm that activates an unlocking mechanism when the shell is grasped as the automatic pickup removes it.

7 Claims, 8 Drawing Sheets

AMMUNITION MAGAZINE FOR A COMBAT VEHICLE

BACKGROUND OF THE INVENTION

The invention concerns an ammunition magazine for a combat vehicle, wherein the shells are stowed upright and perpendicular to the floor and whence they are removed automatically by an ammunition positioner that has an arm with a pivoting pickup at its end, with several magazine shafts, wherein the shells are stowed with their base against a base plate and secured by a shell holder.

A combat vehicle with an ammunition magazine of this type at the center, from which the shells are removed by an ammunition positioner of the aforesaid type is described for example in U.S. application Ser. No. 320,015 filed Mar. 7, 1989.

SUMMARY OF THE INVENTION

The object of the present invention is to improve an ammunition magazine of the type described in the foregoing and in the preamble to claim 1 to the extent that the shells in the ammunition magazine will be reliably protected in the shell holder against jolting in all three dimensions even when the vehicle shakes extensively, even though a shell can be rapidly unlocked and removed automatically by the ammunition positioner.

This object is attained in accordance with the invention in that the shell holder has at least two pairs of tongs-like shell-securing arms that at least partly surround the jacket of the shell, one side of which rests against a stationary guide, on the opposite side, that pivot one above another toward the longitudinal axis of the magazine shaft and, closing subject to a resilient force, around another axis that parallels the first outside the magazine shaft, and that, when closed, can be locked closed by a mechanism that can be unlocked by a component on the positioning arm that activates an unlocking mechanism when the shell is grasped as the automatic pickup removes it.

The basic theory behind the invention is that a shell resting upright in the magazine shaft is secured stationary by shell-securing arms and can be locked by a special locking mechanism into a position that cannot be unlocked until the ammunition-positioner pickup has grasped the shell, subsequent to which the shell can easily be removed and positioned.

There are many possible designs for the locking mechanism. Two particularly practical embodiments will be described hereinafter with reference to the drawings. The locking mechanism in one practical embodiment is designed such that the shell-securing arm is locked by a spring and unlocked by the unlocking component against the force of the same spring.

In another advantageous embodiment the locking is accomplished by activation of the weight of the shell against the force of a spring, and the locking mechanism is stopped in the locking position. When the shell is removed, the stopping action is released and the unlocking occurs subject to the force of the spring. The advantage of this embodiment is that it prevents unintentional unlocking of the shell holder when the magazine shaft rotates with a shell in the space. An unintentional blocking of the shell-securing arm in the empty state must also be prevented by the locking mechanism in this embodiment, eliminating interference by an intruding shell-securing arm while the shells are being introduced into the magazine shaft.

It is also possible in the design in accordance with the invention to couple the shell-securing arms in several magazine shafts positioned one behind another such that the arms will open wide enough during the unlocking process to allow the shell to be removed but without the arms being completely released until a shell has been removed from magazine shaft to the rear. The advantage is that a shell that has been introduced into the magazine shaft by the ammunition positioner's pickup will be positioned in the center of the shell holder from three sides for the lifting or lowering procedure.

Two embodiments of an ammunition magazine in accordance with the invention will now be described in detail with reference to the drawings, wherein

DETAILED DESCRIPTION OF THE INVENTION

Figure 1:
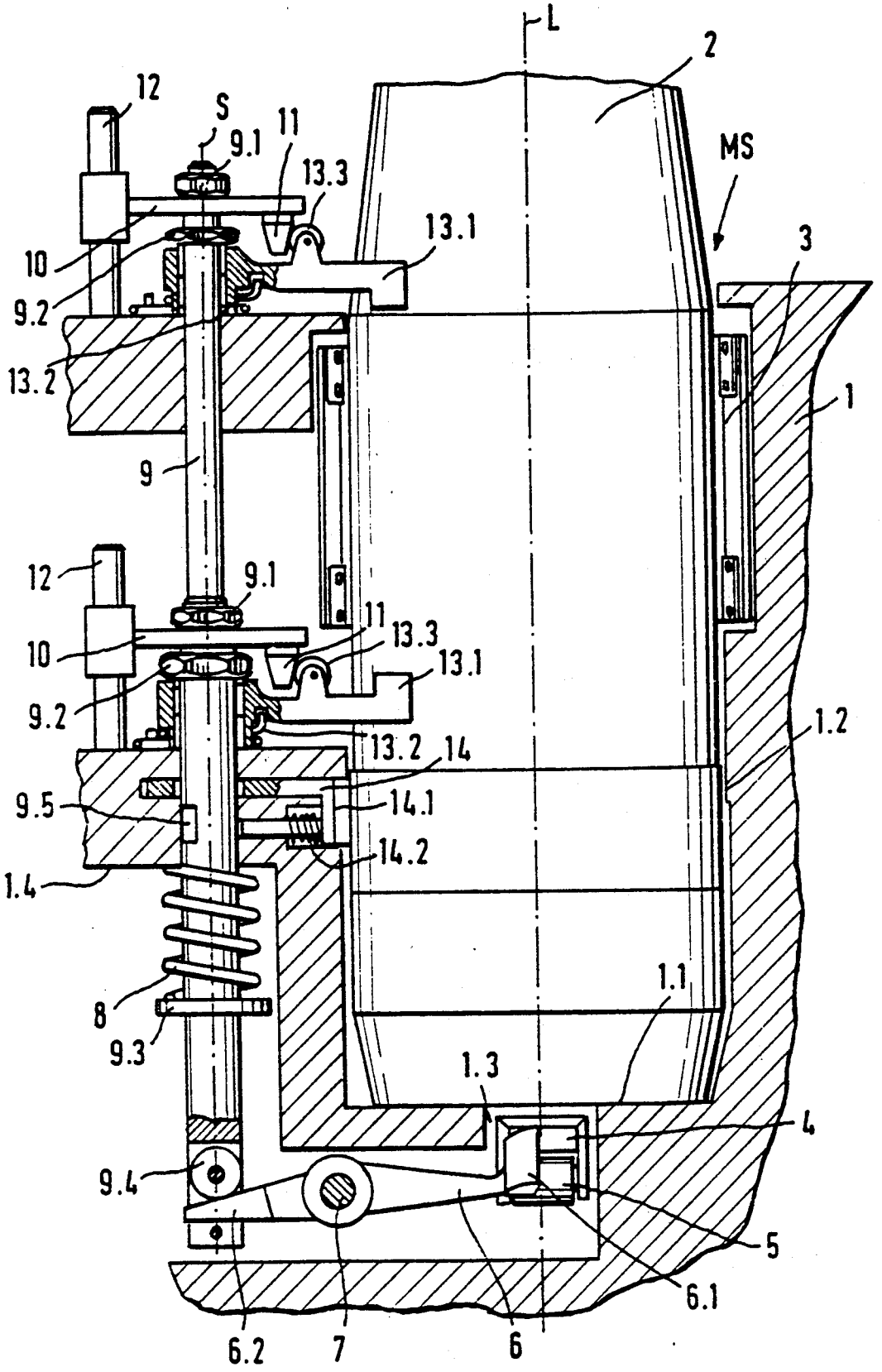
FIG. 1 is a vertical section through the vicinity of the magazine shaft in an ammunition magazine.

The ammunition magazine illustrated in FIGS. 1 through 5 has a base 1 that accommodates several magazine shafts MS, only one of which is illustrated in FIG. 1. Magazine shaft MS is accommodated in base 1 such that each shell 2 will rest point-up on a base plate 1.1 with its surface resting on one side against a stationary guide 1.2, whereas a shell holder that can be locked and unlocked and that will be described in greater detail hereinafter engages the opposite side.

Figure 10:
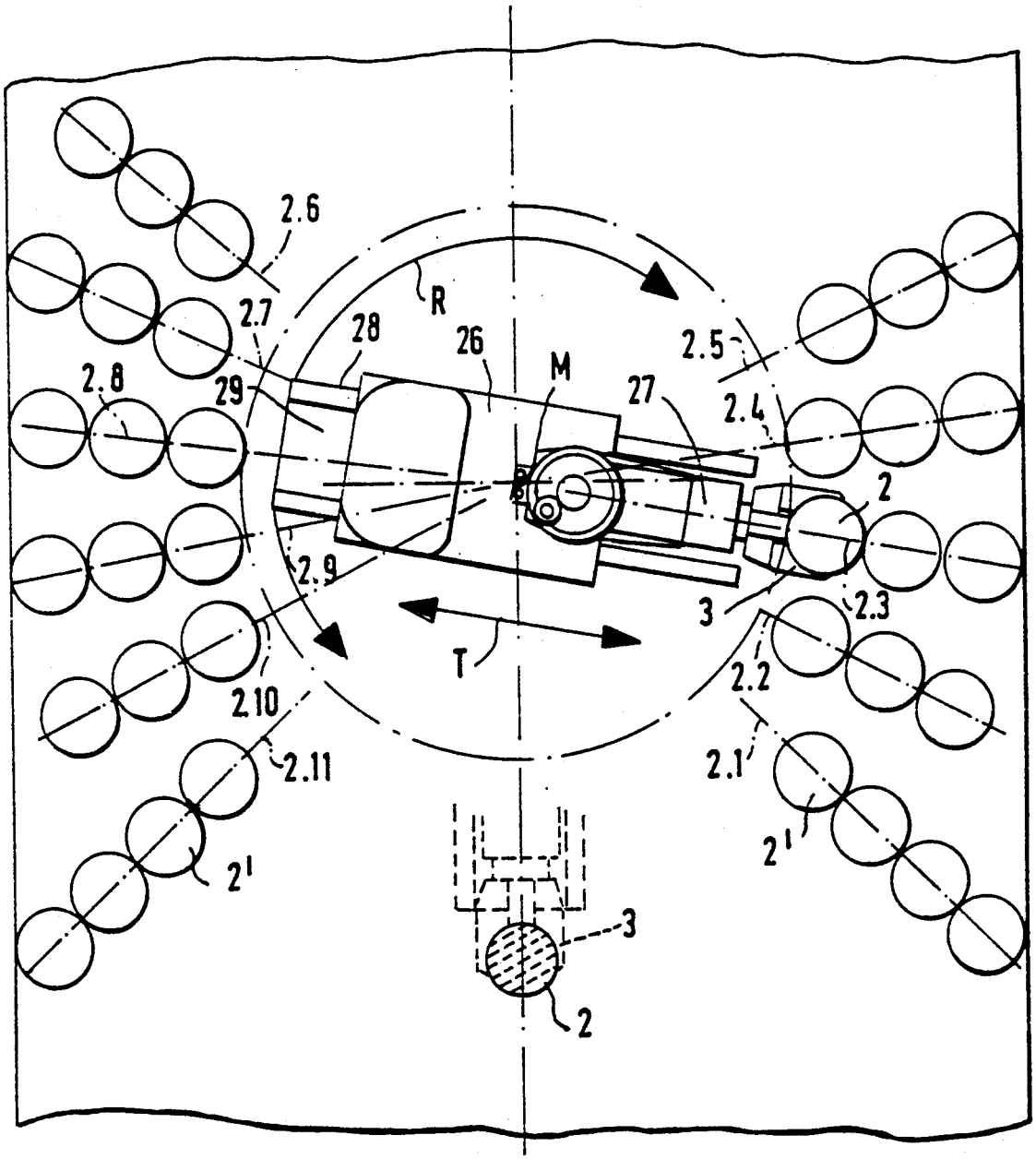
FIG. 10 is a view of part of the inside of a combat vehicle with upright shells and an ammunition positioner.

The overall ammunition magazine is accommodated inside a combat vehicle as illustrated in detail in FIG. 10, which schematically illustrates part of the inside of an otherwise unillustrated combat vehicle. Inside the vehicle, shells 2' are stowed upright and perpendicular to the floor in several rows 2.1 to 2.11, with each row comprising three or four shells one behind another such that the longitudinal axes of the rows are oriented toward a common point M, whereby the front ends of rows 2.1 to 2.11 are far enough apart to leave an empty space inside the vehicle and between the rows of shells wherein an ammunition positioner 26 is located. Ammunition positioner 26 has a positioning arm 27 with a pickup 3 pivoting on the front end and capable of grasping the surface of a shell 2 like a pair of pinchers in order to remove it. Ammunition positioner 26 is mounted on a base 29 that rotates on the floor of the vehicle in the direction indicated by double-headed arrow R. Mounted on base 29 are rails 28, on which ammunition positioner 26 travels back and forth in the direction indicated by double-headed arrow T. Ammunition positioner 26 can be rotated in direction R into alignment with any of rows 2.1 to 2.11 of shells 2', and positioning arm 27 can be displaced in direction T along with pickup 3 up to the frontmost shell in a row, shell 2 in row 2.3 for example, to allow pickup 3 to grasp shell 2 and remove it from the ammunition magazine, which is for simplicity's sake not illustrated in FIG. 10. This procedure will be described in greater detail hereinafter. Once shell 2 has been removed, the ammunition positioner can be pivoted into the position represented by the discontinuous lines in FIG. 10, wherein the shell can be released by pickup 3 for further handling as described by way of example in cited U.S. application Ser. No. 320,015.

Figure 11:
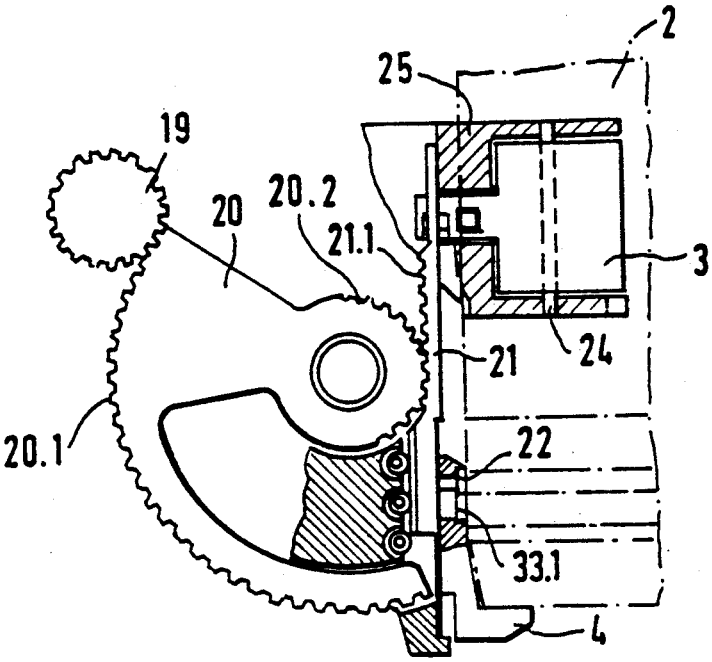
FIG. 11 is a partly sectional side view of the pickup and unlocking component in the ammunition positioner illustrated in FIG. 10.
Figure 12:
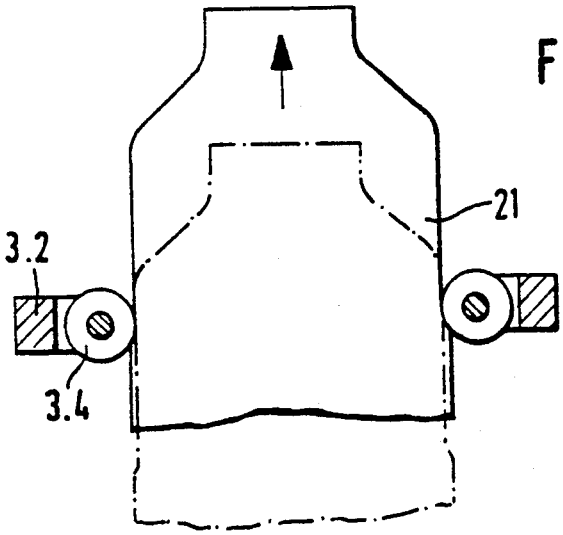
FIG. 12 illustrates part of the plunger that is a component of the pickup in the ammunition positioner illustrated in FIG. 11.

FIGS. 11 and 12 illustrate in greater detail how the pickup 3 on positioning arm 27 operates. Pickup 3 is driven by a cogwheel 19 that engages a crown 20.1. A pickup segment 20 has another crown 20.2 that meshes with a rack 21.1 mounted along a plunger 21. Components 19, 20, and 21 are mounted on the front end of positioning arm 27, and plunger 21 parallels the central axis of an upright shell 2. Pincher-like pickup 3 is accommodated inside a fork 25, and each jaw is in the form of a two armed lever that pivots around an axis 24. The ends 3.2 of this lever that point toward plunger 21 constitute control arms, between which the plunger travels and which rest on supporting rollers 3.4 against the plunger. As will be evident from FIG. 12, plunger 21 differs in width to the extent that the jaws of pickup 3 will open or close depending on the plunger's position. Jaws 3 rest on unillustrated compression springs against pickup fork 25 in such a way that they are forced open. Once a shell has been grasped between pickup jaws 3 the pickup segment 20 that is driven by cogwheel 19 will force plunger 21 up as illustrated in FIG. 11, forcing control arms 3.2 together and closing pickup jaws 3.

Also positioned on positioning arm 27 below pickup 3 is a shoe 4 that travels along with the pickup toward shell 2. Plunger 21 has a carrier 22 that fits into a groove 33.1 on pickup shoe 4, establishing a non-mechanical connection between plunger 21 and pickup shoe 4, which accordingly lifts along with the plunger. As will be evident from FIG. 11, pickup shoe 4 rests against the base of the shell while it is being removed.

When positioning arm 27 moves along with pickup 3 toward a shell 2 to remove it (FIG. 10), shoe 4 will also move toward the shell, arriving, as illustrated in FIGS. 1 through 5, in a recess 1.3 in base 1 below base plate 1.1 and hence below shell 2.

An ammunition positioner of the type briefly described herein is described in the copending U.S. application Ser. No. 07/546,626 filed Jun. 29, 1990 (corresponding to German Application P 3 922 317.5).

An ammunition positioner of this type can insert a shell 2 into magazine shaft MS and remove it therefrom. During the removal procedure for example, pickup 3 is initially applied around the shell to prevent it from tipping over but without securing it firmly. The shell is then lifted by pickup shoe 4 to a prescribed level once the shell holder has been unlocked, subsequent to which the pickup closes tight around the jacket of the shell, which can now be removed from the magazine shaft by the positioning arm.

The shell holder has two pairs of shell-securing arms 13.1 that surround part of the circumference of the shell like a pair of tongs. One pair is positioned a prescribed distance above the other along the length L of magazine shaft MS. Shell-securing arms 13.1 are subject to a shank spring 13.2 that forces them together, and they pivot around an axis S outside magazine shaft MS and paralleling its longitudinal axis L. In the closed state, shell-securing arms 13.1 are locked to secure shell 2 by a locking mechanism to the extent that it cannot open even when the ammunition magazine is shaken or jolted. The locking mechanism has locking cones 11, each of which is associated with one shell-securing arm 13.1. The locking cones 11 associated with one pair are mounted on the bottom of a locking plate 10 that travels along a bolt 12 that parallels axes L and S such that, when locking plate 10 is raised or lowered, locking cones 11 will execute a motion that positions them either nearer to or farther away from shell-securing arms 13.1. The locking cones 11 all operate in conjunction with counteracting components 13.3, roller stops in the present embodiment, on the top of shell-securing arms 13.1. In the locking state illustrated in FIG. 1, locking cones 11 rest against roller stops 13.3 and accordingly secure shell-securing arms 13.1.

Locking plate 10 is activated by an activating rod 9 that is positioned coaxial with the axis S of rotation of shell-securing arms 13.1 and travels toward that axis. Activating rod 9 extends through locking plate 10 and has carriers 9.1 and 9.2, each positioned at a prescribed distance away from each side of the plate and translating the rod's displacement to the plate. In its lowered position, illustrated in FIG. 1 and corresponding to the locked state, activating rod 9 extends through a helical compression spring 8, one end of which rests against a supporting surface 1.4 on base 1 and the other end of which rests against a supporting plate 9.3 that is rigidly secure to the rod.

The displacement of activating rod 9 is governed by a rocker 6 in the form of a two-armed lever that pivots on a bolt 7 perpendicular to the longitudinal axis L of the magazine shaft and hence to activating rod 9. One arm of rocker 6 is coupled to activating rod 9 by way of a sloping surface 6.2 and of a transmission roller 9.4, and the other arm has an activating slope 6.1 at its outer end that fits into a recess 1.3 in the base 1 below shell 2 such that, as will be evident from FIGS. 2 through 5, a roller on pickup shoe 4 will enter the recess in activating slope 6.1 and pivot rocker 6 clockwise out of the position illustrated in FIG. 1, lifting activating rod 9 and transmitting the elevating motion to locking plate 10 by way of carriers 9.2 and hence to locking cones 11.

Figure 2:
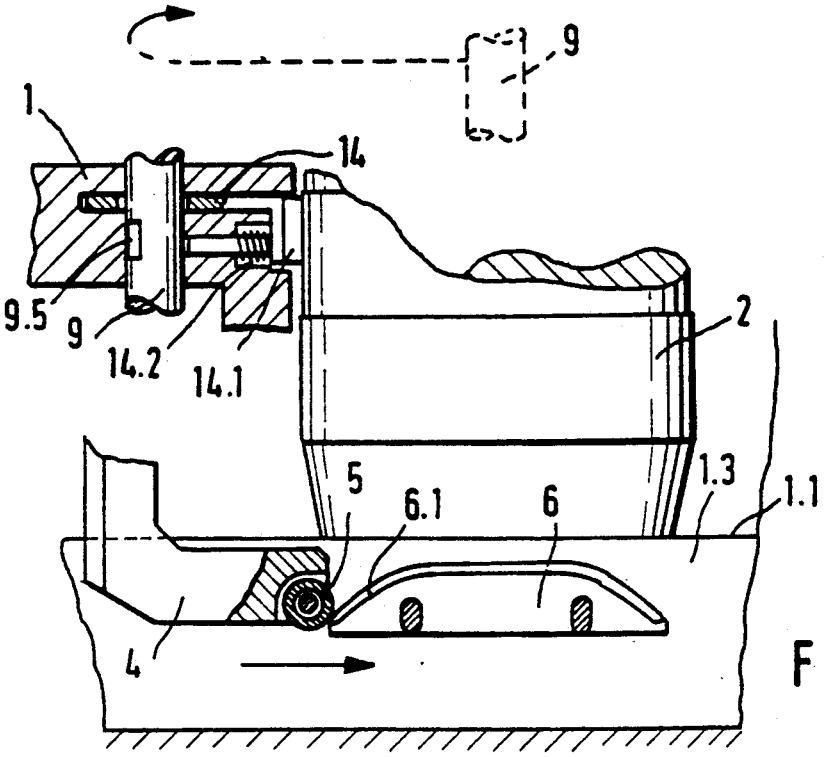
FIGS. 2 through 4 are sections through the bottom of the ammunition magazine illustrated in FIG. 1 during various phases of removing a shell.
Figure 3:
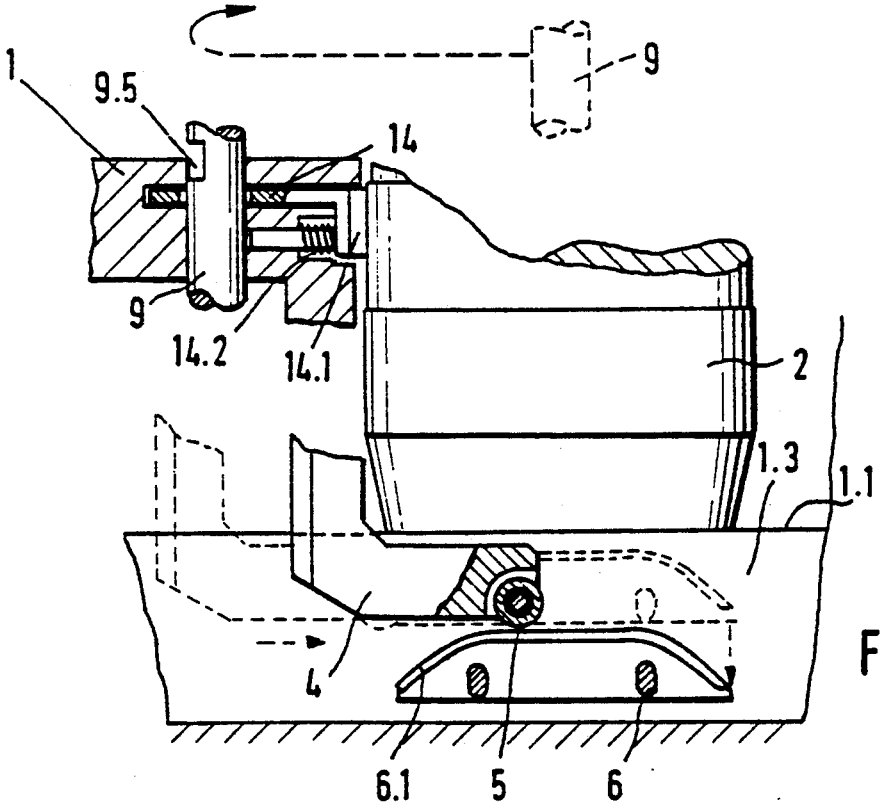
Figure 5:
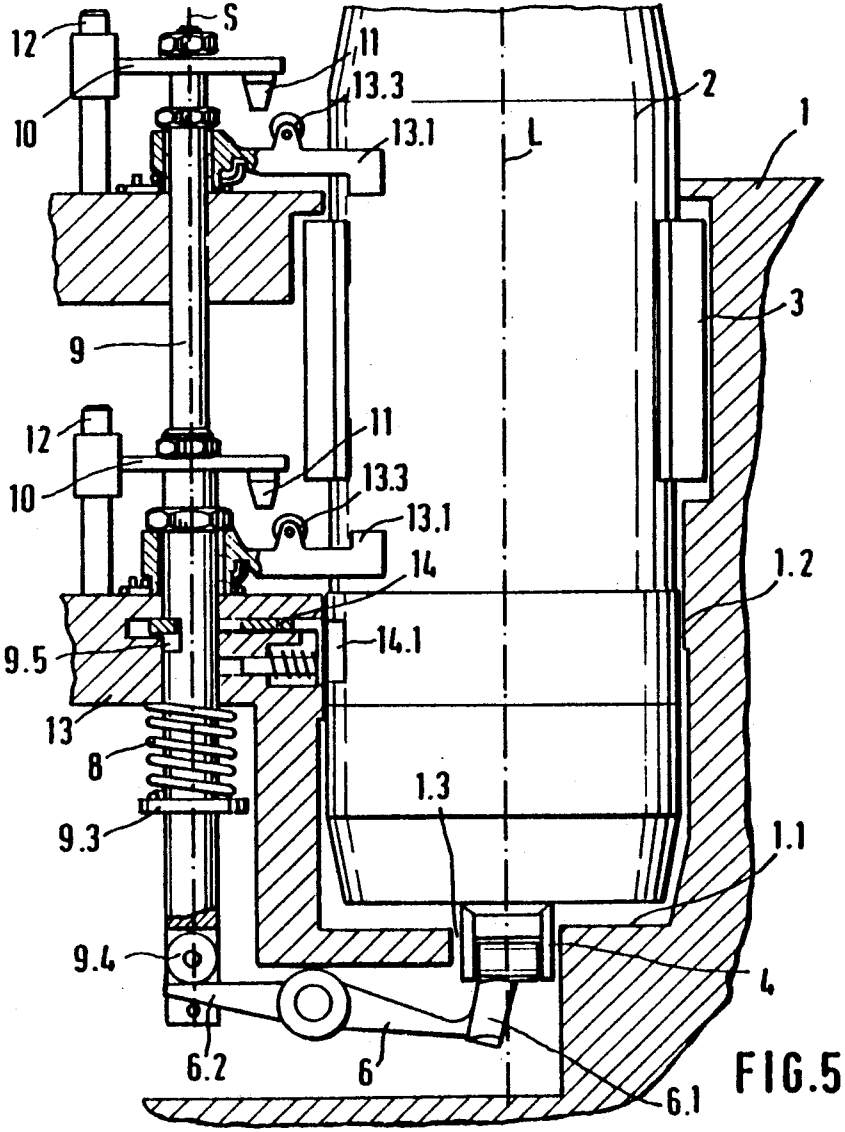
FIG. 5 is a view similar to that in FIG. 1 of the magazine shaft illustrated in FIG. 1 with the locking mechanism completely unlocked.
Figure 4:
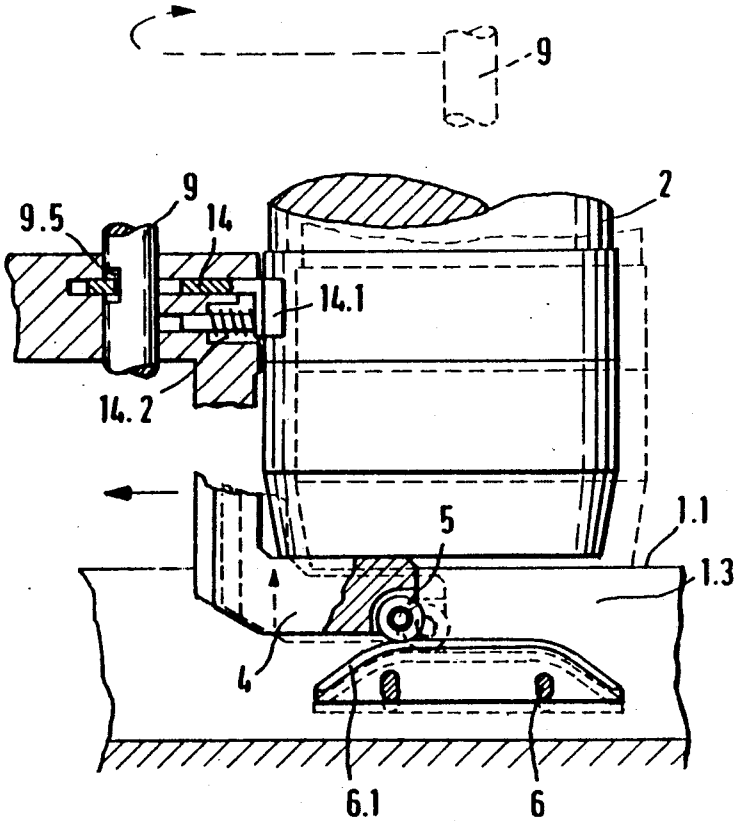

How pickup shoe 4 controls activating rod 9 will be very evident from FIGS. 2 through 4. FIG. 5, finally, illustrates the unlocked state, wherein locking cones 11 have lifted off roller stops 13.3 and pickup 3 is in position. The unlocked shell-securing arms 13.1 can now press down against the force of springs 13.2, and shell 2 can be farther advanced. As will be evident from FIG. 4, the shell is lifted for farther advance to a prescribed height—3 mm above base plate 1.1—and pickup shoe 4 is accordingly extracted from activating slope 6.1. To prevent helical compression spring 8 from initiating any undesired blocking of shell-securing arms 13.1, the embodiment illustrated in FIGS. 1 through 5 has a special stopping mechanism that secures the locking mechanism in the unlocked position once a shell has been removed. This stopping mechanism has a slide 14 that travels perpendicular to activating rod 9 and has one end in magazine shaft MS, with an activating slope 14.1 at that end. When there is a shell 2 in magazine shaft MS, slide 14 is secured by way of slope 14.1 against the force of a compression spring 14.2 in the position illustrated in FIG. 1. Further occurrences in relation to slide 14 while the locking mechanism is being unlocked are illustrated in FIGS. 2 through 5. The position of part of activating rod 9 is represented along with slide 14 rotated 90° and displaced in FIGS. 2 through 4 to provide a better overview.

Activating rod 9 has a recess 9.5 in the vicinity of slide 14. When activating rod 9 is raised into the unlocking position, recess 9.5 is, as will be evident from FIG. 3, originally displaced into a position above slide 14. When shell 2 is to be advanced farther, its surface will release slide 14, which is accordingly displaced toward the magazine shaft by compression spring 14.2. Activating rod 9 will simultaneously slide down once rocker 6 has been released, with the result that, as illustrated in FIG. 4, slide 14 will snap into recess 9.5 and hence, as will also be evident from FIG. 5, activating rod 9 will be secured in the unlocking position even if shell 2 has been entirely removed from the magazine shaft. The activating slope 14.1 on slide 14 is shaped to ensure that the slide will snap in before the roller 5 on pickup shoe 4 leaves the activating slope 6.1 on rocker 6 and accordingly releases the rocker, permitting activating rod 9 to drop all the way (FIG. 4).

The ammunition magazine illustrated in FIGS. 6 through 9 is a variation of the embodiment illustrated in FIGS. 1 through 5, the essential difference residing in how the locking mechanism is controlled. All of the parts illustrated in FIGS. 6 through 9 that are identical with the parts illustrated in FIGS. 1 through 5 are labeled with the same reference numbers.

Figure 6:
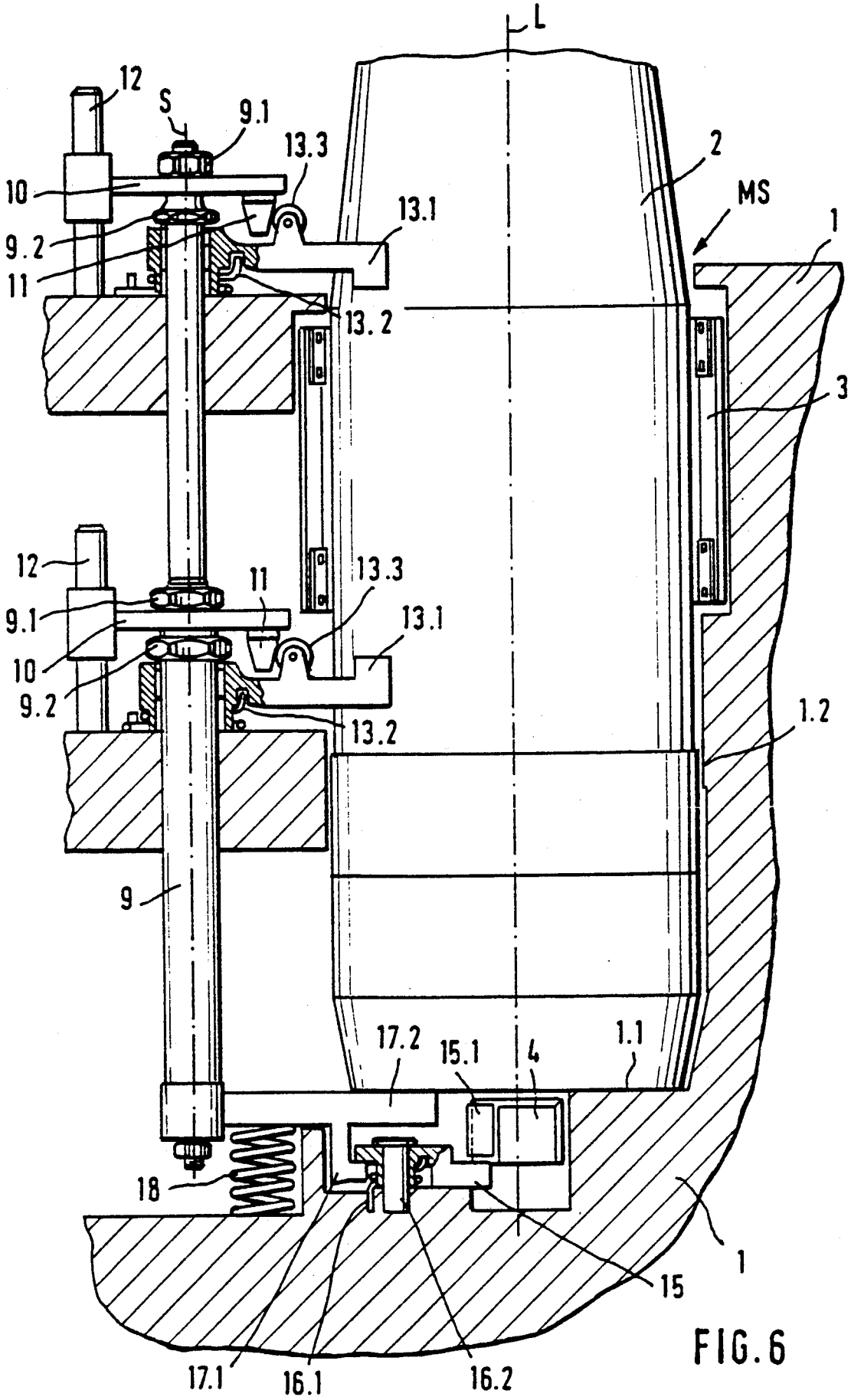
FIG. 6 is a view similar to that in FIG. 1 of another embodiment of an ammunition magazine.
Figure 7:
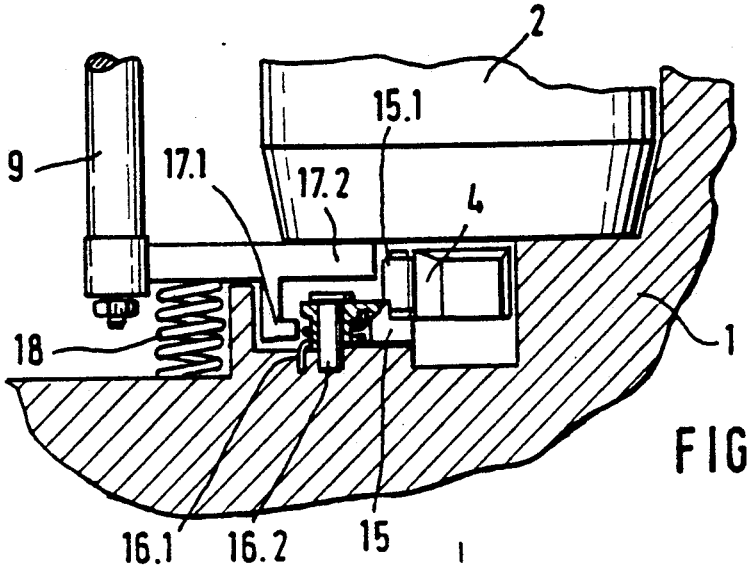
FIG. 7 illustrates the bottom of the magazine shaft illustrated in FIG. 6 during the unlocking process.

Accommodated in the base 1 of the ammunition magazine are several magazine shafts MS, only one of which is illustrated in FIG. 6. Shell 2 rests upright on base plate 1.1 and rests with one side of its jacket against a stationary guide 1.2, whereas on the other side it is secured by the aforesaid shell-securing arms 13.1, which are forced together by shank springs 13.2. The locking mechanism also has locking cones 11 mounted on a locking plate 10, positioned by bolts 12, and raised and lowered by activating rod 9 by way of carriers 9.1 and 9.2. Locking cones 11 operate in conjunction with roller stops 13.3 mounted on shell-securing arms 13.1 to lock the arms.

Shell 2 is removed by pickup 3 and the locking mechanism is unlocked by pickup shoe 4, which arrives in the recess 1.3 in base 1 below the shell as pickup 3 engages.

Figure 8:
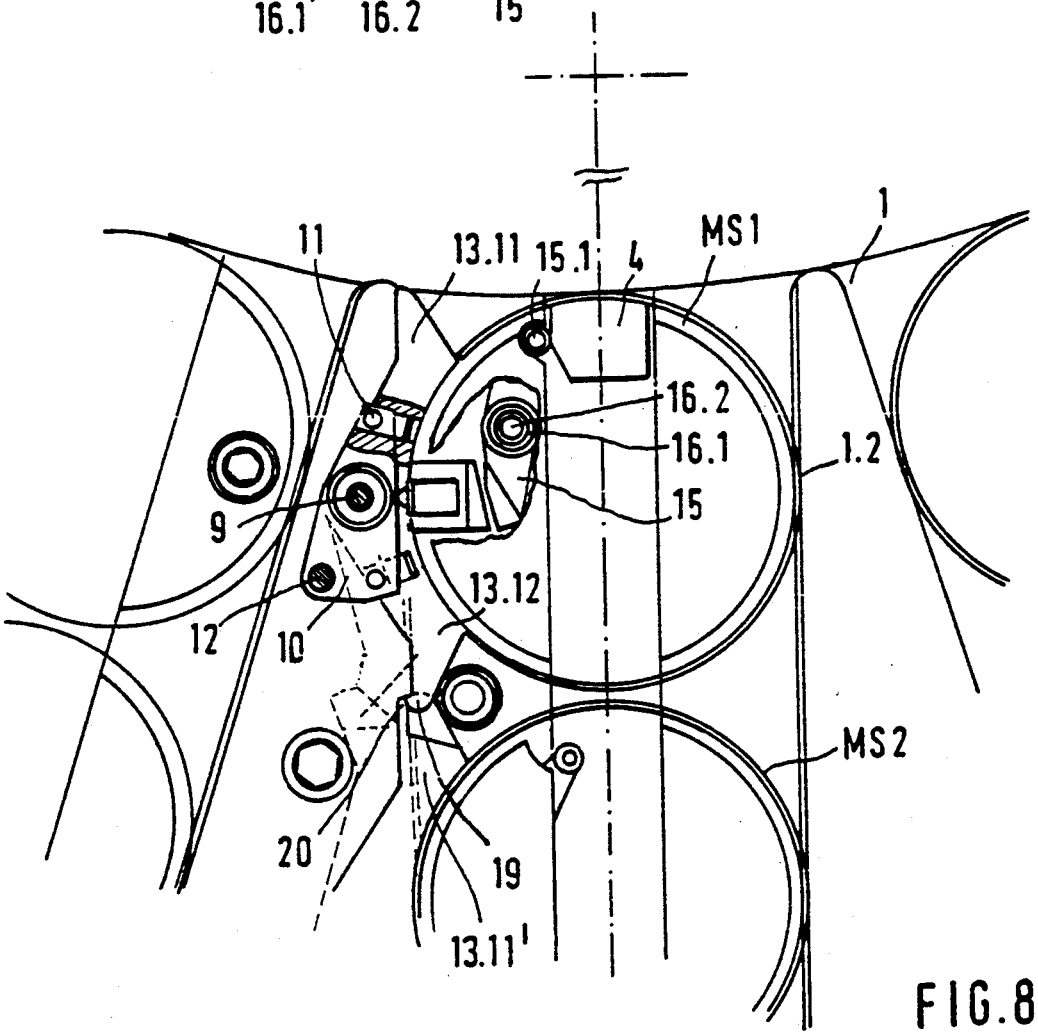
FIG. 8 is a partly sectional view of part if the ammunition magazine illustrated in FIG. 6.
Figure 9:
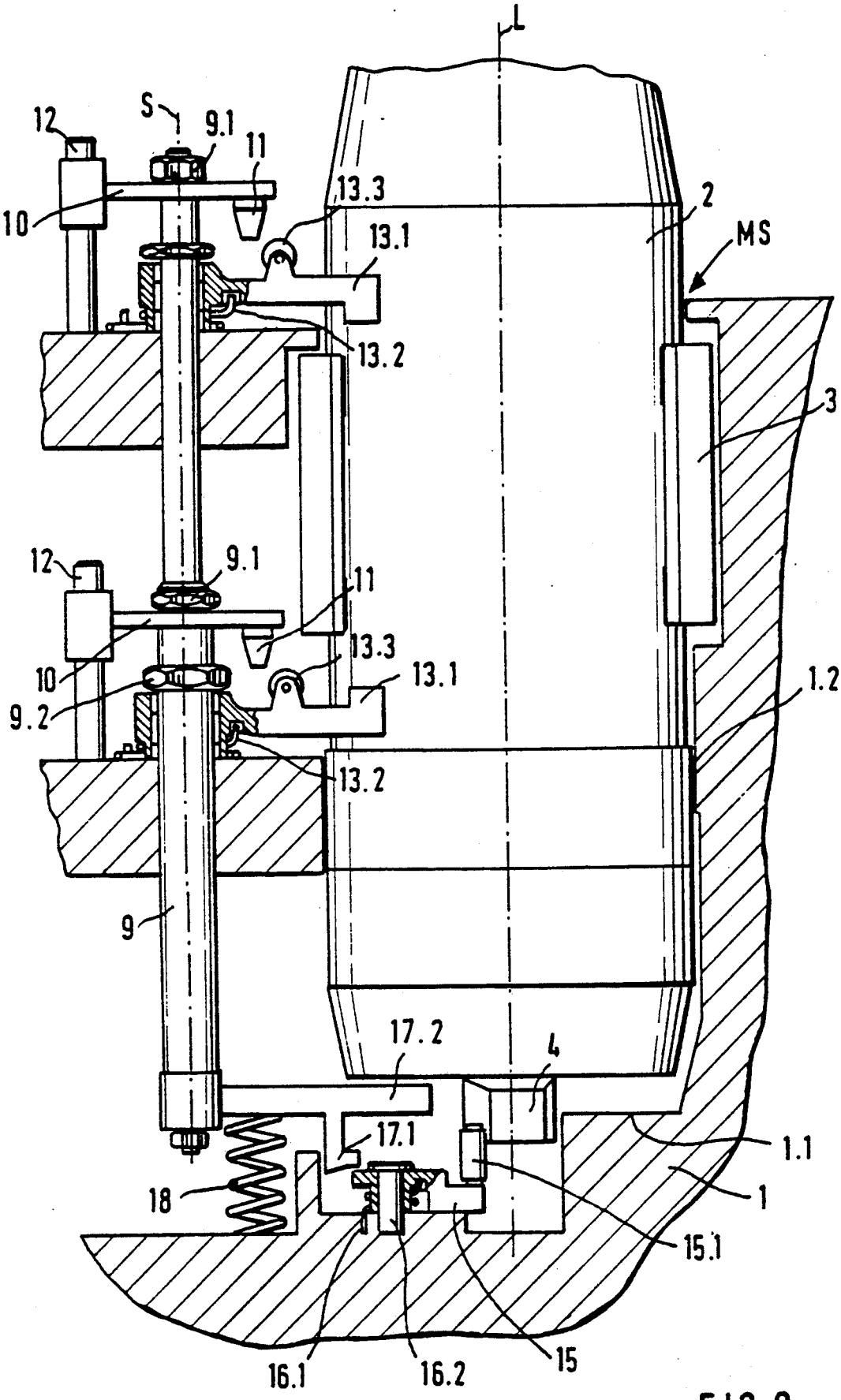
FIG. 9 is a view similar to that in FIG. 6 of the ammunition magazine illustrated in FIG. 6 with the locking mechanism unlocked.

At the bottom of activating rod 9 is a closure plate 17.2 that travels along the length L of magazine shaft MS in conjunction with the rod. A compression spring 18 that rests against both base 1 and the bottom of closure plate 17.2 exerts a force on the plate toward the unlocking position of the locking mechanism. Closure plate 17.2 is also positioned extending into the magazine shaft MS to the level of base plate 1.1 and, as will be evident from FIG. 6, shell 2 rests on it. It will accordingly be evident as illustrated in FIGS. 6 and 8 that activating rod 9 is forced down against the force of helical compression spring 8 and hence into the locking position illustrated in FIG. 6 when a shell is inserted. Mounted on the bottom of closure plate 17.2 is a securing hook 17.1 that can be engaged by a securing lever 15 that pivots around a pin 16.2 that parallels the longitudinal axis of magazine shaft MS. A shank spring 16.1 maintains the securing lever in a closed position, wherein it engages securing hook 17.1 such that, even when closure plate 17.2 has been released, activating rod 9 cannot be lifted into the unlocking position by compression spring 18. Securing lever 15 is a two-armed lever. One arm engages securing hook 17.1. Mounted on the other arm is a roller 15.1 that operates in conjunction with an activating slope on pickup shoe 4 such that pickup shoe 4, as it enters magazine shaft MS, forces securing lever 15 against the force of spring 16.1 into a release position. Activating rod 9 is accordingly released every time pickup shoe 4 is in. As shell 2 is lifted by pickup shoe 4, closure plate 17.2, or activating rod 9, is forced by helical compression spring 8 into the unlocking position, wherein it remains while the shell is advanced, because, once pickup shoe 4 has moved out, spring 16.1 will force securing lever 15 into a position below securing hook 17.1, preventing the recurrence of locking (FIG. 9).

The embodiment illustrated in FIGS. 6 through 9 has an accessory mechanism that can also be present in the embodiment illustrated in FIGS. 1 through 5. This accessory is illustrated in detail in FIG. 8. As will be evident from the figure, the base 1 of the ammunition magazine has several magazine shafts, one behind another in relation to the direction that the ammunition positioner removes shells in. FIG. 8 illustrates magazine shafts MS1 and MS2. Of the shell-securing arms 13.1 that constitute pairs, the arm 13.11 illustrated in FIG. 8 faces the ammunition positioner and arm 13.12 faces away from it. The accessory is positioned where the ends of the arm 13.12 in magazine shaft MS1 and of the arm 13.11' in magazine shaft 2 face each other directly. Arm 13.12 has at its outer end an extension 19, below which a stop 20 on the outermost end of arm 13.11' engages to the extent that it will not be released even when activating rod 9 or locking cones 11 are in the unlocking position and will be prevented from folding up even while a shell is being removed. Shell 2 can accordingly easily be removed from the frontmost magazine shaft 1 because frontmost arm 13.11 is unlocked and rear arm 13.12 is secured by arm 13.11'. The advantage of this embodiment is that a shell that has been introduced into magazine shaft MS1 by pickup 3 is positioned at three points in the center of the shell holder for the process of being lifted or deposited.

What is claimed is:

1. An ammunition magazine for a combat vehicle, comprising: a floor; means forming a plurality of magazine shafts in the floor, each having a longitudinal axis and each including a base plate at a bottom thereof for stowing shells with a base of the shell against the base plate and the shells upright and perpendicular to the floor; an ammunition positioner having an arm with a pivoting pickup at one end for removing the shells from the magazine shafts; and a shell holder for securing the shells in each magazine shaft comprising at least two pairs of tongs-like shell-securing arms that at least partly surround an outer wall of the shell, a stationary guide resting against the outer wall of the shell opposite the shell-securing arms, means mounting the shell-securing arms one above the other for pivoting movement toward the longitudinal axis of the magazine shaft about a pivot axis parallel to the longitudinal axis of the magazine shaft and outside the magazine shaft, means resiliently biasing the shell securing arms into a closing position against the outer wall, a mechanism for locking the shell-securing arms closed and a mechanism for unlocking the locking mechanism in response to a component on the positioner arm when the shell is grasped as the pickup removes it.

2. The ammunition magazine as in claim 1, wherein the locking mechanism has locking components movable parallel to the longitudinal axis of the magazine shaft and introduceable into counteracting components rigidly secured to the arms when the shell-securing arms are together, wherein the locking components associated with each magazine shaft are connected to a common activating rod that slides parallel to the longitudinal axis of the magazine shaft with the unlocking mechanism secured to one end below the base plate of the magazine shaft and activatable to lift the common activating rod into an unlocking position, wherein the locking components release the counteracting components, wherein the unlocking component comprises a shoe that engages below the base of the shell while it is being grasped.

3. The ammunition magazine as in claim 2, wherein the locking components are locking cones, wherein each cone is associated with one pair of shell holders and is mounted on a locking plate that travels along a bolt paralleling the longitudinal axis of the magazine shaft and carriers for raising and lowering the locking plate on the common activating rod and the counteracting components comprise roller stops that operate in conjunction with the locking cones.

4. The ammunition magazine as in claim 2, further comprising a spring maintaining the common activating rod in the lowered locking position and the unlocking mechanism has a rocker pivoting around an axis perpendicular to the longitudinal axis of the magazine shaft, one arm of which is fastened to an end of the activating rod and another arm of which has an activating slope that a roller on the pickup shoe rolls over in such that while the shell is being grasped the common activating rod will be lifted as a result of a rocking motion on the part of the rocker into the unlocking position against the force of the spring.

5. The ammunition magazine as in claim 4, wherein the locking mechanism has a stopping mechanism that maintains the common activating rod in the unlocking position once the shell has been removed and that has a slide that travels perpendicular to the common activating rod in the unlocking position subject to the force of a spring and snaps into a recess in the common activating rod and that has an activating end provided with an activating slope and accommodated in the magazine shaft such that it will be maintained in a release position by resting against the outer surface of the shell against the force of a spring.

6. The ammunition magazine as in claim 2, further comprising a spring for maintaining the activating rod the raised unlocking position and the unlocking mechanism has a closure plate rigidly secured to an end of the common activating rod and perpendicular to it and positioned in the vicinity of the base plate such that the shell in the magazine shaft rests on it and secures the common activating rod in the lowered locking position against the force of the spring, and a two-armed securing lever pivotable around an axis parallel to the longitudinal axis of the magazine shaft and positioned below the closure plate with one arm in the closed position engaging subject to the force of a spring a securing hook fastened to the closure plate, wherein another arm has a roller mounted thereon that travels over an activating slope on the pickup shoe while the shell is being grasped such that the securing lever will be pivoted into a release position against the force of a spring.

7. The ammunition magazine as in claim 1, wherein the magazine shafts are positioned one behind another in relation to a removal direction, wherein the shell-securing arm that faces the next magazine shaft to the rear has an extension that a stop on an opposite shell-securing arm in the next magazine shaft to the rear engages behind such that it can be pivoted back into the folded-up state in the unlocking position only when the pair of shell-securing arms in the next magazine shaft to the rear is also in the unlocking position.

* * * * *